United States Patent [19]

Brison et al.

[11] Patent Number: 4,710,980

[45] Date of Patent: Dec. 8, 1987

[54] PROTECTING GARNMENT USABLE IN PARTICULAR IN HAIRDRESSING SALONS AND NEW TYPE OF TOWEL INCORPORATED IN THE DESIGN OF SAID GARNMENT

[76] Inventors: Bernard Brison, 9 chemin des Rivières, 69260 Charbonnieres; Jacques Galerneau, 92 rue G. Clémenceau; Alex Gontier, 44 chemin de Tafignon, both of Sainte Foy Les Lyon; Gérard Petrozzi, 39 rue des Bienvenus, 69110 Villeurbanne, all of France

[21] Appl. No.: 25,728

[22] Filed: Mar. 13, 1987

[30] Foreign Application Priority Data

Mar. 13, 1986 [FR] France ..... 86 03779

[51] Int. Cl.[4] ..... A41B 13/10

[52] U.S. Cl. ..... 2/50

[58] Field of Search ..... 2/49, 50, 48, 114, DIG. 7

[56] References Cited

U.S. PATENT DOCUMENTS

| | | | |
|---|---|---|---|
| 2,093,483 | 9/1937 | Sackett | 2/50 |
| 2,882,529 | 4/1959 | Argo | 2/50 |
| 2,922,164 | 1/1960 | Liff | 2/49 R |
| 2,947,004 | 8/1960 | Pfile | 2/50 |
| 3,031,676 | 5/1962 | Larson | 2/50 |

FOREIGN PATENT DOCUMENTS

| | | |
|---|---|---|
| 1800869 | 6/1967 | Fed. Rep. of Germany . |
| 2558019 | 6/1977 | Fed. Rep. of Germany . |
| 3423002 | 1/1986 | Fed. Rep. of Germany . |
| 855106 | 3/1939 | France . |
| 1482101 | 3/1966 | France . |
| 2355478 | 6/1976 | France . |

*Primary Examiner*—Doris L. Troutman

*Attorney, Agent, or Firm*—Bruns and Wall

[57] ABSTRACT

Protecting garment usable in particular in hairdressing salons, of the type composed of an overall or cape, designed to be wrapped around the user's body, and of a towel adaptable on said overall.

According to the invention:

the overall or cape is a one-piece garment, the geometrical shape of which is such as to allow a sufficient development to protect efficiently the user, said garment having a neck opening to allow the user's head through, the towel at least is made from a complex material containing an absorbing non-woven material, and is triangular-shaped, said towel being provided along one of the sides of the triangle with means for securing it on the overall, at the level of the shoulders, at the back of the neck opening.

5 Claims, 2 Drawing Figures

PROTECTING GARNMENT USABLE IN PARTICULAR IN HAIRDRESSING SALONS AND NEW TYPE OF TOWEL INCORPORATED IN THE DESIGN OF SAID GARNMENT

The present invention relates to a protecting garment usable for example in hairdressing salons or other similar application, such as beauty parlors, the medical field, etc . . . , which is designed to protect a person's body while a treatment is applied to his or her head (hair, face, etc . . . ).

Throughout the description, the garment according to the invention will be described in the case of a hairdressing salon, but obviously this is not in any way restrictive and the invention also covers all other similar applications.

For a long time now, different types and shapes of garments have been used in hairdressing salons to protect the customer against stains, infiltration of hairs through their clothing, etc . . . What is used normally is, first an overall or like garment worn directly by the person, and second, a towel which, normally, is rectangular shaped and of which one of the edges is "inserted" between the overall and the client's neck. In general, the protection used is an overall and towel combination in cloth, which therefore raises problems of hygiene and must be washed normally after each use. In addition to this problem of hygiene, the cloths have the disadvantage of keeping in hairs, stains and humidity. Because of this, hairdressing salons need to have a large stock of linen, which for them, represents a great investment with very high cleaning costs.

It has been proposed, quite a long time ago, to replace the towels with disposable towels in non-woven material for example. The towels proposed heretofore are not altogether satisfactory due to the fact that it is difficult to keep them on the overall which is used to protect the customer. What is more, with the said non-woven materials that are used for producing the towels, humidity is transmitted to the overall through capillarity.

Now a new type of garment has been found, and this is the object of the present invention, which garment combines an overall and a towel and eliminates the aforesaid drawbacks, while remaining inexpensive to produce, easy to fit over the person to be protected, and in particular, preventing all transfers of humidity through capillarity.

In general, the garment according to the invention is composed of an overall or cape which is wrapped around the customer's body, and of a towel which is adaptable on said overall, said garment being characterized in that:

the overall or cape is a one-piece garment, the geometrical shape of which is such as to allow a sufficient development to protect efficiently the user, said garment having a neck opening to allow the user's head through, the towel at least is made from a complex material containing an absorbing non-woven material, and is triangular-shaped, said towel being provided along one of the sides of the triangle with means for securing it on the overall, at the level of the shoulders, at the back of the neck opening.

According to one preferred embodiment of the invention:

the overall and towel are both made from the same material which is a complex material consisting first of a non-woven layer capable of absorbing humidity and second, a waterproof film, bonded to the aforesaid non-woven material;

during use, the two faces constituted by the film are placed in facing relationship, the absorbing face being, for the overall, on the user's side, whereas for the towel, it is external;

the towel may be provided with pre-traced markings in the form of lines which are parallel to the base of the triangle and to the height, said lines acting as a guide during the hair-cutting operation.

The invention will be more readily understood on reading the following description with reference to the accompanying drawings, in which.

Figure 1:
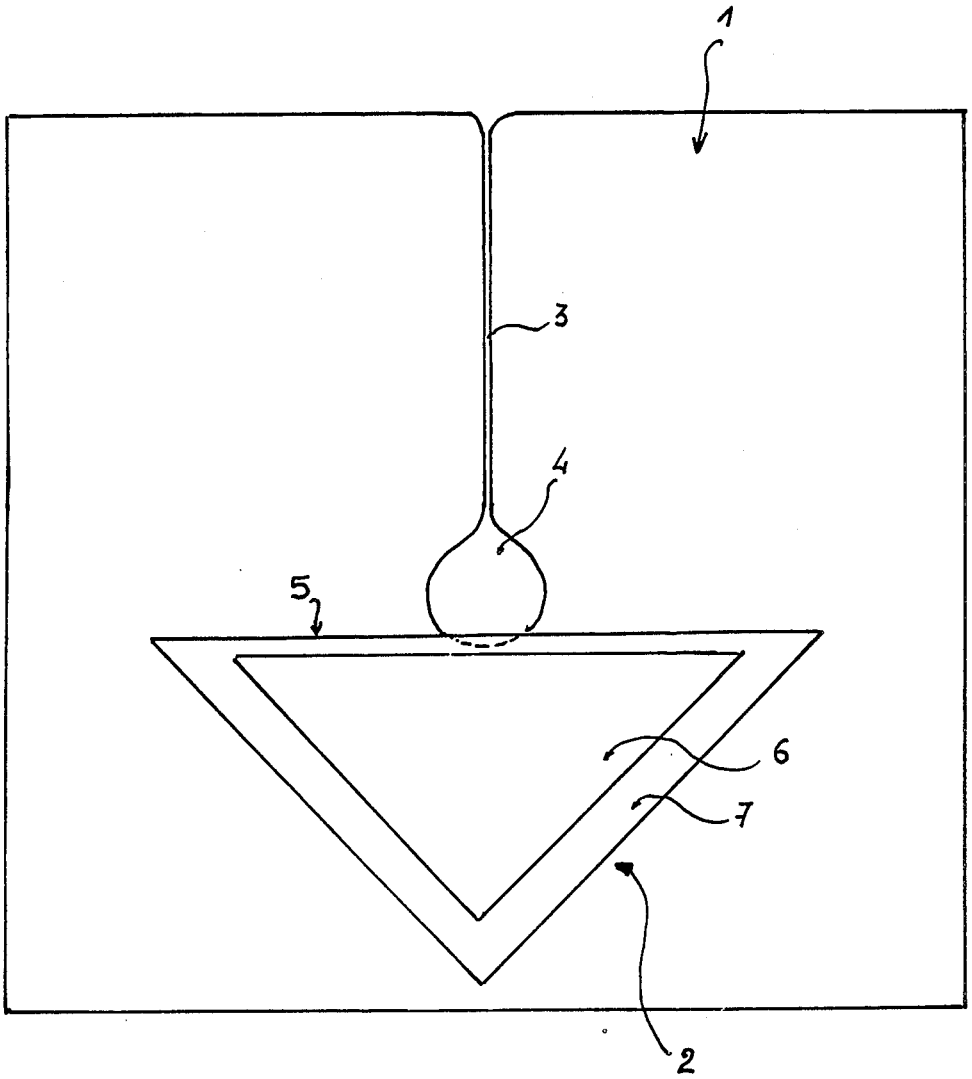
FIG. 1 is a diagrammatical plan view of an overall and towel combination according to the invention.

Referring now to the drawings, these show that the garment according to the invention is composed of an overall (1) and of a towel (2) equipped with means for temporarily joining them one to the other.

The overall (1) is parallelepipedal-shaped, the dimensions of which are sufficient for wrapping around the user (such as for example a rectangle of 1.50 m width and 1.60 m length). This piece of material comprises a slit (3) with, in the center part, an opening (4) for the user's head. Said slit (3) makes the garment easier to use but is not a necessity.

As for the towel (2), this is triangular-shaped, with, close to its base (5), means (not shown) such as adhesive means, or pressing-on fastening means, etc . . . permitting the fastening thereof onto the surface of the overall at the back of the neck opening. The dimensions of the towel may vary as a function of the applications, a towel having the shape of a triangle of 1.10 m base and 0.55 m height being normally suitable in most cases.

Figure 2:
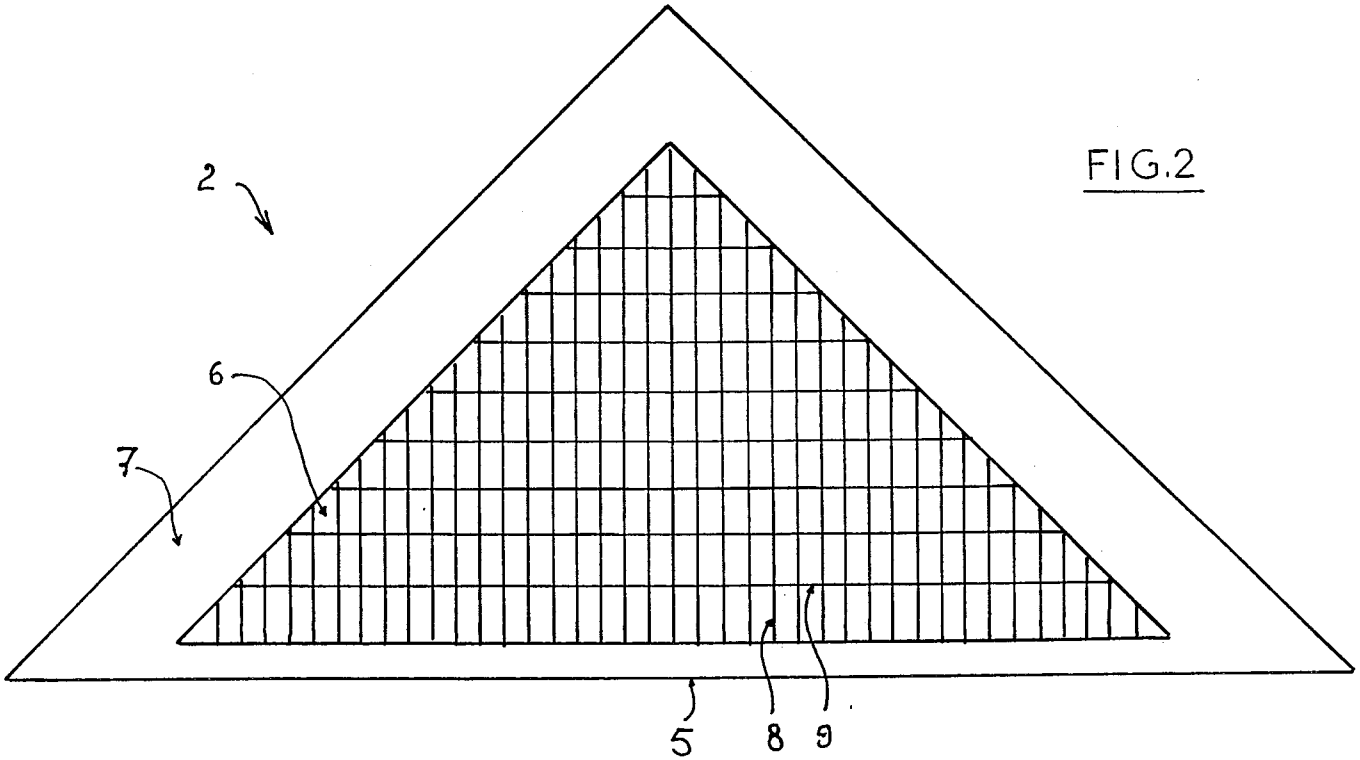
FIG. 2 is a plan view of a towel according to the invention.

The two elements of the garment according to the invention, i.e. the overall and the towel, are preferably produced from a complex material consisting of a film (7) bonded to a non-woven layer (6) of cotton wool type. The film ensures waterproofness whereas the non-woven layer absorbs the humidity, for example during the hair shampoo. As illustrated in FIG. 2, the absorbing part in non-woven material (6) has slightly smaller dimensions than the film (7). These two elements are joined together by any conventional means, such as by adhesive bonding or by stitching.

When used, the overall is placed over the user so that the film is on the outside, this permitting the fastening of the towel thereon in such a way that the absorbing part (6) is on the outside.

Moreover, according to the preferred embodiment illustrated in FIG. 2, the towel (2) comprises vertical (8) and horizontal (9) line marks parallel one to the other. Said lines form a grid which constitutes some sort of a pattern guiding the hair cutting.

Compared with the conventional solutions, the garment according to the invention offers many advantages insofar as it can be produced from rather inexpensive materials, hence be disposable after every use. It is furthermore extremely efficient, easy to use, adaptable to any type of person whatever their build.

Also, because of the specifically triangular shape of the towel and because said towel is fastened to the overall along its base, substantially at the level of the user's shoulders, it is possible to knot it around the user's head after the shampoo.

Obviously the invention is not in any way limited to the description given hereinabove, and on the contrary, covers all modifications that can be brought thereto without departing from its scope.

For example, although in the present case, the overall is of relatively simple design, it could also be produced as an overall of conventional design, the towel, in this case being still rectangular-shaped and made from a complex material having one waterproof face and one absorbing face.

It is also possible to provide pockets on the overall, said pockets being removable or fixed permanently. Such pockets, designed for example to receive tools such as combs, scissors, etc . . . or reference cards, may be transparent and provided, for example, on the arms side.

Moreover, although, normally, the fastening means are provided only along the base of the triangle forming the towel, they could also be provided along each side, which would make it possible to reverse it during use, and even to use it several times.

What is claimed is:

1. Protecting garment usable in particular in hairdressing salons, of the type composed of an overall or cape, designed to be wrapped around the user's body, and of a towel adaptable on said overall, garment wherein:

the overall or cape is a one-piece garment, the geometrical shape of which is such as to allow a sufficient development to protect efficiently the user, said garment having a neck opening to allow the user's head through, the towel at least is made from a complex material containing an absorbing non-woven material, and is triangular-shaped, said towel being provided along one of the sides of the triangle with means for securing it on the overall, at the level of the shoulders, at the back of the neck opening.

2. Garment as claimed in claim 1, wherein the overall and towel are both made from the same material which is a complex material consisting first of a non-woven layer capable of absorbing humidity and second, a waterproof film, bonded to the aforesaid non-woven material.

3. Garment as claimed in claim 2, wherein during use, the two faces constituted by the film are placed in facing relationship, the absorbing face being, for the overall, on the user's side, whereas for the towel, it is external.

4. Towel usable with a garment such as claimed in claim 1, wherein said towel is made from a complex material containing an absorbing non-woven material, it is triangular-shaped and is provided along one of the sides of the triangle, with means for fastening it on an overall or the like, at the level of the shoulders.

5. Towel as claimed in claim 4, wherein said towel comprises pre-traced markings in the form of lines, parallel, first to the base of the triangle, and second to the height, said lines acting as a guide during the hair cutting operation.

* * * * *